United States Patent [19]

Nagai et al.

[11] 4,298,114

[45] Nov. 3, 1981

[54] CONTROL CIRCUIT FOR A PRESS

[75] Inventors: Shunichi Nagai; Hidekazu Higashi, both of Komatsu, Japan

[73] Assignee: Kabushiki Kaisha Komatsu Seisakusho, Tokyo, Japan

[21] Appl. No.: 58,071

[22] Filed: Jul. 16, 1979

[30] Foreign Application Priority Data

Dec. 29, 1978 [JP] Japan ..... 53-163940

[51] Int. Cl.[3] ..... B30B 15/14

[52] U.S. Cl. ..... 192/129 A; 100/53; 192/131 R

[58] Field of Search ..... 192/142 R, 129 A, 144, 192/131 R; 100/53

[56] References Cited

U.S. PATENT DOCUMENTS

| | | | |
|---|---|---|---|
| 2,639,796 | 5/1953 | Dean | 192/144 X |
| 2,830,686 | 4/1958 | Blume et al. | 192/129 A X |
| 2,886,155 | 5/1959 | Hadley | 192/142 R |
| 2,893,529 | 7/1959 | Hadley | 192/142 R |
| 2,905,838 | 9/1959 | King et al. | 192/142 R X |
| 3,004,647 | 10/1961 | Andrus et al. | 192/142 R |
| 3,249,820 | 5/1966 | Stimmel | 192/129 A X |
| 3,509,976 | 5/1970 | Coon | 192/142 R |
| 4,072,222 | 2/1978 | Coon | 192/131 R |

FOREIGN PATENT DOCUMENTS

| | | | |
|---|---|---|---|
| 602382 | 7/1960 | Canada | 192/142 R |

*Primary Examiner*—Rodney H. Bonck

*Attorney, Agent, or Firm*—Spensley, Horn, Jubas & Lubitz

[57] ABSTRACT

A control circuit for a press can perform various control functions simply by electrically detecting two modes of change, i.e. from OFF to ON and from ON to OFF, of a single rotary cam switch mounted on a press. Until reaching a first slide stroke angle at which the first change of the rotary cam switch takes place, operation of the press depends upon an ON or OFF state of a push button and thereafter the operation continues regardless of the ON-OFF state of the push button. After reaching a second slide stroke angle at which the second change of the rotary cam switch takes place, the operation of the press is stopped with the slide being stopped at a top dead center regardless of depression or non-depression of the push button and restarting of the press function is prevented in case the push button is kept depressed.

9 Claims, 4 Drawing Figures

CONTROL CIRCUIT FOR A PRESS

BACKGROUND OF THE INVENTION

This invention relates to a control circuit for a press in which a rotary cam switch for stopping the press at the top dead center is also used for preventing the restart thereof.

In general, a press is provided with a one-stroke one-stop mechanism, so that, even if the operating push button is maintained depressed, the press is stopped at the top dead center after every stroke.

In order to stop a press at the top dead center and to prevent the restart of the press, a conventional control circuit is provided with two separate switches, namely, a top dead center stop rotary cam switch and a restart prevention rotary cam switch, One example of the conventional control circuit is as shown in FIG. 1, in which the above-described rotary cam switches are employed in combination.

The operation of the conventional control circuit will be described. FIG. 2 shows the intervals (or slide stroke angles) during which the restart prevention rotary cam switches RCLS1 and RCLS2 and the top dead center stop rotary cam switches RCLS3 and RCLS4 are maintained closed (ON), respectively. In FIG. 1, reference numeral 1 designates a relay coil having contacts 1*a* and 1*b*, and reference numeral 2 designates a relay coil having contacts 2*a*, 2*b* and 2*c*.

(1) Before the starting operation is effected (with the slide stroke angle 0°)

Since push buttons PB1 and PB2 for effecting the starting operation are not operated yet, i.e., their contacts a are closed (on) while their contacts b are open (off), the operating relay coil 2 is not energized yet. Accordingly, the normally closed contact 2*a* is closed (on), the restart prevention relay coil 1 is energized to close its normally open contact 1*a*. In this case, as is clear from FIG. 2, the restart prevention rotary switches RCLS1 and RCLS2 are closed, and therefore the restart prevention relay coil is self-held.

(2) Effecting the starting operation

Upon operation of the operating push buttons PB1 and PB2, the operating relay coil 2 is energized to close its contact 2*c* because, in this case, the normally open contact 1*b* of the relay coil 1 is maintained closed. As a result, a clutch brake solenoid SOL for driving the press is energized to start the press.

(3) Before the slide stroke angle 140°

Before the slide stroke angle reaches 140°, the top dead center stop rotary cam switches RCLS3 and RCLS4 are maintained open, and therefore the relay coil 2 is not self-held by its relay contact means 2*b*. Accordingly, the press can be stopped by restoring the operating push buttons PB1 and PB2 when necessary.

(4) From the slide stroke angle 140° to 260°

At the slide stroke angle 140°, the top dead center stop rotary cam switches RCLS3 and RCLS4 are turned on and the relay coil 2 is self-held by its contact 2*b*. The press thereby continues its operation regardless of depression or non-depression of the operating push buttons PB1 and PB2.

(5) From the slide stroke angle 260° to 330°

When the slide stroke angle has reached 260°, the restart prevention rotary cam switches RCLS1 and RCLS2 are opened to deenergize the restart prevention relay coil 1. Even if the restart prevention rotary cam switches RCLS1 and RCLS2 are closed again when the slide stroke angle has reached 280°, the operating relay coil 1 is not energized again because the self-holding of the operating relay coil 1 by the contact 1*a* has been released. That is, the contact 1*b* is placed in "off" state. Accordingly, even if the operating push buttons PB1 and PB2 are kept depressed, the press can be stopped (i.e., the restart prevention function can be effected) when the rotary cam switches RCLS3 and RCLS4 are opened.

(6) To the top dead center

When the slide stroke angle has reached 330°, the top dead rotary cam switches RCLS3 and RCLS4 are opened, and the self-holding of the operating relay coil 2 is released. As a result, the clutch brake solenoid SOL is deenergized, and the press, being run by its inertia, is stopped at the top dead center (i.e., the top dead center stop function is effected).

As is clear from the above description, in the conventional control circuit, the functions of preventing the restart of the press and stopping the press at the top dead center are performed by using the separate rotary cam switches.

A rotary cam switch which requires precision machining is expensive and, besides, adjustment of mounting position thereof is difficult.

SUMMARY OF THE INVENTION

In view of the foregoing, an object of this invention is to provide a control circuit for a press, in which a top dead center stop rotary cam switch is used commonly for preventing the restart of the press and stopping the press at the top dead center, thereby to reduce the number of rotary cam switches used therein.

Furthermore, in the control circuit according to the invention, the rotary cam switches are not connected directly to the clutch brake solenoid to which large current is applied, with the result that the service lives thereof can be increased.

BRIEF DESCRIPTION OF THE DRAWINGS

In the accompanying drawings:

FIG. 1 is a circuit diagram showing one example of a conventional control circuit for a press, which has been already referred to;

FIG. 2 is a diagram showing one example of the operation angles of rotary cam switches shown in FIG. 1, which has been already referred to;

DETAILED DESCRIPTION OF THE INVENTION

Figure 1:
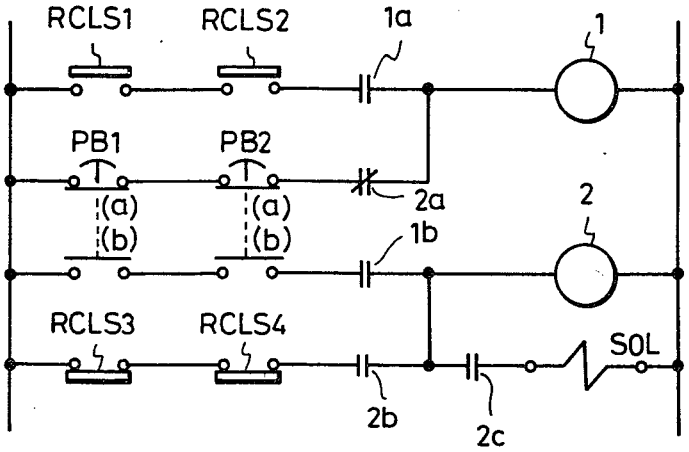
FIG. 1 PRIOR ART
Figure 2:
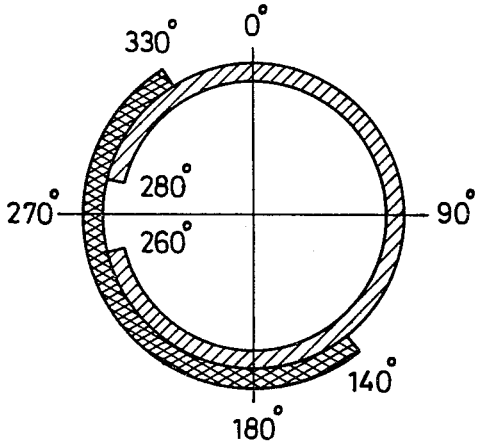
FIG. 2 PRIOR ART
Figure 3:
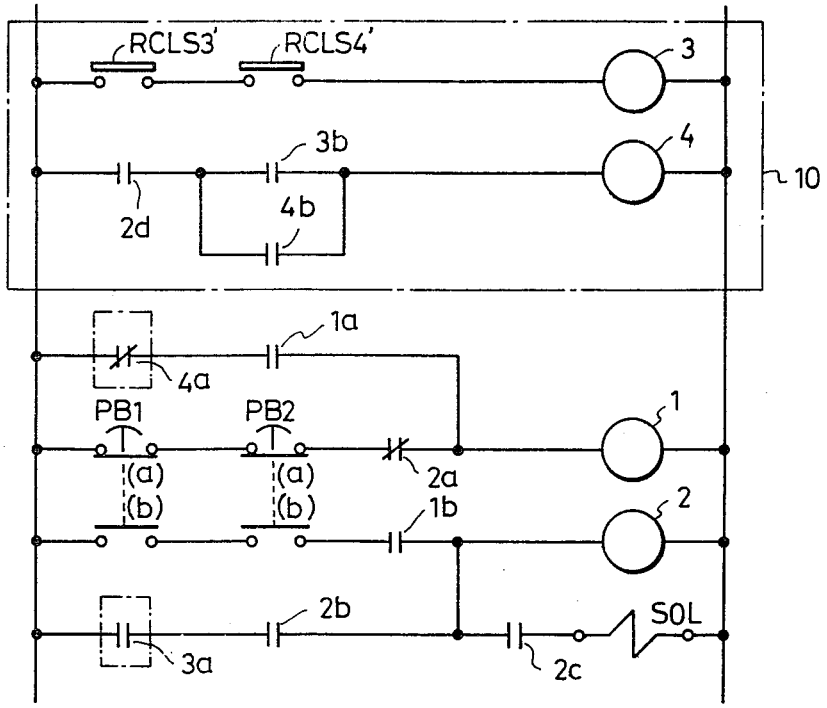
FIG. 3 is a circuit diagram showing one example of a control circuit for a press according to this invention.

One preferred example of a control circuit for a press according to this invention is shown in FIG. 3, in which those components which have been described with reference to FIG. 1 have been designated by similar reference characters, and parts newly added or modified with respect to FIG. 1 are surrounded by the one-dot chain lines.

Instead of the above-described restart prevention rotary cam switches RCLS1 and RCLS2 and top dead center stop rotary cam switches RCLS3 and RCLS4 in FIG. 1, a relay contact 4*a* (hereinafter referred to as "a restart prevention relay contact 4a" when applicable) and a relay contact 3a (hereinafter referred to as "a top dead center stop relay contact 3a" when applicable). These relay contacts 4a and 3a are operated by a relay contact operating control circuit 10 incorporating rotary cam switches RCLS3' and RCLS4', thereby to obtain the same function as those described with reference to FIG. 1.

Figure 4:
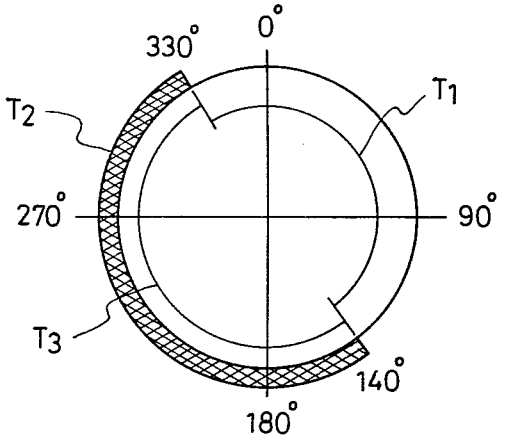
FIG. 4 is a diagram showing the operation angles of rotary cam switches, a restart prevention relay contact means, and a top dead center stop relay contact means.

In the relay contact operating control circuit 10, the rotary cam switches RCLS3' and RCLS4' are substantially the same as the top dead center stop rotary cam switches RCLS3 and RCLS4 in FIG. 1. The rotary cam switches RCLS3' and RCLS4' are closed when the slide stroke angle is in a range from 140° to 330°, and opened when it is out of the range, as shown in FIG. 4. Accordingly, a relay coil 3 is maintained energized when the slide stroke angle is in the range, to close the top dead center stop relay contact means 3a (cf. FIG. 4). A relay coil 4 is energized when the relay contact 2d of the relay coil 2 and the relay contact 3b of the relay coil 3 are closed, i.e., when the relay coil 3 is energized with the press being in the operating state (or when the press stroke angle is 140°), and the relay coil 4 is self-held by its relay contact 4b. When the relay coil 2 is deenergized (i.e., when the press stroke angle has reached 330°), the relay coil 4 is also deenergized. Accordingly, the normally closed contact of the relay coil 4, namely the restart prevention relay contact 4a is maintained closed (on) when the press stroke angle is in a range from 330° through 0° to 140°. The time period during which the contact 4a is on is denoted by reference character $T_1$ in FIG. 4.

The operation of the circuit shown in FIG. 3 will be described.

(1) Before the starting operation is effected (the slide stroke angle 0°)

The operating push buttons PB1 and PB2 for effecting the starting operation are not depressed yet (i.e., their contacts a are closed, while their contacts b are open), and therefore the operating relay coil 2 is not energized yet. However, the restart prevention relay coil 1 is energized, and its normally open contact 1a is kept closed. In this case, as the relay contact 2d of the relay coil 2 is open, the relay coil 4 is not energized, and its normally closed contact 4a is closed. Accordingly, the restart prevention relay coil 1 is energized and then self-held by the relay contact 1a.

(2) Effecting the starting operation

Upon depression of the operating push buttons PB1 and PB2 (i.e., when the contacts a are opened, and the contacts b are closed), the operating relay coil 2 is energized because the normally open contact 1b of the relay coil 1 has been closed. As a result, the relay contact 2c is closed, to energize the clutch brake solenoid SOL thereby to start the press.

(3) Before the slide stroke angle 140°

The rotary cam switches RCLS3' and RCLS4' are maintained open until the slide stroke angle reaches 140°. Therefore, the relay coils 3 and 4 are not energized, and the operating relay coil 2 is not self-held. Accordingly, the press can be stopped by restoring the push buttons PB1 and PB2.

(4) From the slide stroke angle 140° to 330°

When the slide stroke angle has reached 140°, the rotary cam switches RCLS3' and RCLS4' are closed (This time period is denoted by $T_2$ in FIG. 4), and the relay coil 3 is energized. As a result, the top dead center stop relay contact 3a is closed (This time period is denoted by $T_3$ in FIG. 4) and the relay coil 2 is self-held by its relay contact 2b so that the press continues its operation even if the operating push buttons PB1 and PB2 are restored. When the relay coil 3 is energized as described above, its relay contact 3b is closed to energize the relay coil 4 (with the relay contact means 2d being closed). The relay coil 4 is self-held by its relay contact 4b. When the relay coil 4 is energized, the restart prevention relay contact 4a is opened, and therefore the restart prevention relay coil 1 is deenergized, as a result of which the relay contact 1b is opened. Thus, if the top dead center stop relay contact 3a is opened, the self-holding of the operating relay coil 2 can be released (i.e., the restart prevention function can be performed) even though the operating push buttons PB1 and PB2 are erroneously maintained depressed.

(5) Until the slide stroke angle reaches the top dead center

When the slide stroke angle has reached 330°, the rotary cam switches RCLS3' and RCLS4' are opened to deenergize the relay coil 3. As a result, the top dead center stop relay contact 3a is opened, to deenergize the clutch brake solenoid SOL, and the press is run by the inertia to the top dead center (i.e., the top dead center stop function is performed). Even if the operating push buttons PB1 and PB2 are erroneously maintained depressed, the operating relay coil 2 is deenergized by opening of the contact 1b and the press is positively stopped (i.e., the restart prevention function is performed). The operating relay coil 1 has been deenergized by the restart prevention relay contact means 4a.

What is claimed is:

1. A control circuit for a press comprising:

a rotary cam switch which, during each revolution, is closed at a first slide stroke angle and opened at a second slide stroke angle before a top dead center position of the press;

an operating switch which is moved from a stop position to a run position for starting the press;

a first relay circuit which is not energized when the press is started and is energized upon the closing of said rotary cam switch and self-held thereafter;

a second relay circuit which is energized through the operating switch prior to the starting of the press, is self-held after starting of the press until said rotary cam switch is closed and is deenergized by the closing of said rotary cam switch;

a third relay circuit which is energized by moving the operating switch to the run position when the press is not in operation, is deenergized by moving the operating switch to the stop position before the press reaches the first slide stroke angle, is energized and self-held in a stroke angle range between the first slide stroke angle and the second slide stroke angle and is deenergized by deenergization of said second relay circuit after the press reaches the second slide stroke angle even if the operating switch is in the run position, wherein the rotary cam switch controls the energization of the first, second and third relay circuits; and drive means for driving the press by energization of said third relay circuit.

2. In a circuit for controlling a press or the like which includes a drive means for driving the press, at least one control switch which is activated to start the press, top dead center stop relay safety circuitry for removing power from the drive means at a predetermined slide stroke angle of said press so as to cause the press to stop at a top dead center position, and restart prevention relay safety circuitry for preventing the restarting of the press after the stopping thereof until the control switch is deactivated and subsequently reactivated, the improvement comprising a relay control circuit for controlling the energization of the safety circuitry, said relay control circuit including:

at least one rotary cam switch for controlling the operation thereof, wherein each rotary cam switch is said circuit is switched at a first slide stroke angle of the press and reswitched at a second slide stroke angle of the press;

a first relay and a first contact switched thereby, the switching of the first contact controlling the energization of the top dead center stop relay safety circuitry, wherein the first relay is energized at the first slide stroke angle and deenergized at the second slide stroke angle; and a second relay and a second contact switched thereby, the switching of the second contact controlling the energization of the restart prevention relay safety circuitry, said relay control circuit further including a third contact which is switched by the first relay, the switching of the third contact controlling the energization of the second relay.

3. The circuit of claims 2 wherein there are two of said rotary cam switches connected in series.

4. The circuit of claim 2 wherein the drive means is a solenoid.

5. A circuit for controlling a press or the like, comprising:

drive means for driving the press;

at least one power line connected to supply current to the drive means;

a control switch which is engaged to supply power to the drive means;

top dead center stop relay safety circuitry for removing power from the drive means when the press reaches a predetermined slide stroke angle so as to cause the press to stop at a top dead center position regardless of whether or not the control switch is engaged;

restart prevention relay safety circuitry for preventing the application of power to the drive means to start the press for a new cycle until the control switch is disengaged and subsequently reengaged; and control circuitry for controlling the energization of the safety circuitry, said control circuitry including at least one rotary cam switch, each of which is located on a line other than said at least one power line, whereby drive current to the drive means does not pass through any rotary cam switch, wherein each rotary cam switch in said circuit is closed at a first slide stroke angle and opened at a second slide stroke angle.

6. A control circuit for a single cycle press or the like, comprising:

drive means for driving the press;

an operating relay circuit which is energized to power the drive means;

a first control switch which is movable from a first position to a second position to energize the operating relay circuit and start the press, wherein the energization of the operating relay circuit is controllable by means of the control switch until the press reaches a first slide stroke angle;

a top dead center stop circuit which enables the operating relay circuit to power the drive means, irrespective of the position of the control switch, from the first slide stroke angle to a second slide stroke angle which corresponds to a press position before a top dead center position, wherein the top dead center stop circuit includes a first relay which is energized when the rotary cam switch is closed and deenergized when the rotary cam switch is opened, and a top dead center stop contact which is located on a first power line to said drive means and is closed when the first relay is energized;

a restart prevention relay circuit for preventing restarting of the press for a subsequent press cycle in the event that the control switch is erroneously maintained depressed after the press passes the second slide stroke angle, wherein the restart prevention relay circuit includes:

a second relay which is energized when the first relay and operating relay circuit are both energized;

a third relay which is energized before the press is started when the control switch is in its first position and self-held until the first slide stroke angle;

a first restart prevention relay contact which is controlled by the second relay and is opened at the first slide stroke angle to deenergize the third relay; and a second restart prevention relay contact which is located on a second power line and is controlled by the third relay, wherein the second restart prevention relay contact is opened at the first slide stroke angle and is not closed until a point in time after the second slide stroke angle when the control switch is moved back to the first position; and at least one rotary cam switch for controlling the operation of both the top dead center stop circuit and the restart prevention relay circuit, wherein said at least one rotary cam switch is closed at said first slide stroke angle and opened at said second slide stroke angle.

7. A circuit for controlling a single cycle press or the like, comprising:

a first power line including at least one rotary cam switch which is closed at a first press slide stroke angle and opened at a second slide stroke press angle and a top dead center stop relay;

a second power line including a first restart prevention relay;

a third power line including a second restart prevention relay;

a fourth power line including a first contact of a first control switch and the second restart prevention relay;

a fifth power line including a second contact of the first control switch, wherein the control switch is movable between a first position and second position to close the first switch contact or second switch contact, respectively, and an operating relay;

a sixth power line which includes drive means for driving the press;

a connection line between the fifth and sixth power lines which enables the drive means to be powered through the second switch contact; and contact means, controlled by said relays and located on said power lines, for (a) removing power from the drive means at the second slide stroke angle regardless of the position of the control switch to cause the press to stop at a top dead center location, and (b) preventing the restarting of the press and repowering of the drive means for a subsequent press cycle until the control switch has been moved to the first position and then back to the second position, wherein both the top dead center stop function and restart prevention function are provided in a circuit having only two rotary cam switching positions.

8. The control circuit of claims 6 or 7 wherein there are two series connected rotary cam switches which are closed at the first slide stroke angle and opened at the second slide stroke angle.

9. The control circuit of claims 6 or 7 further including a second control switch which is series connected with the first control switch.

* * * * *